US007317887B2

(12) United States Patent
Otaka

(10) Patent No.: US 7,317,887 B2
(45) Date of Patent: Jan. 8, 2008

(54) SHEET FEED DEVICE AND IMAGE FORMING APPARATUS

(75) Inventor: Hisashi Otaka, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 11/293,143

(22) Filed: Dec. 5, 2005

(65) Prior Publication Data

US 2006/0083547 A1 Apr. 20, 2006

Related U.S. Application Data

(62) Division of application No. 10/791,837, filed on Mar. 4, 2004, now Pat. No. 6,993,268.

(30) Foreign Application Priority Data

Mar. 7, 2003 (JP) ..... 2003-061889

(51) Int. Cl.
*G03G 21/00* (2006.01)

(52) U.S. Cl. ..... 399/124

(58) Field of Classification Search ..... 399/21, 399/107, 124, 125

See application file for complete search history.

(56) References Cited

U.S. PATENT DOCUMENTS 3,661,383 A 5/1972 Morrison ..... 271/273
6,145,828 A 11/2000 Arai ..... 271/3.03
6,308,029 B1 10/2001 Yamamoto ..... 399/117
6,564,019 B2 5/2003 Ahn et al. ..... 399/13
6,782,223 B2 8/2004 Yoshida ..... 399/124
6,829,453 B2 * 12/2004 Kouzu ..... 399/124

* cited by examiner

*Primary Examiner*—Hoang Ngo
(74) *Attorney, Agent, or Firm*—Fitzpatrick, Cella, Harper & Scinto

(57) ABSTRACT

A sheet feed device has a door for supporting one of the rollers of a feed roller pair for feeding a sheet, mounted on the apparatus main body so as to be opened or closed on the one end part side in the roller pair axis direction such that the one roller is pressured against the other roller of the feed roller pair provided in the apparatus main body at the time the door is closed. An outer door is supported rotatably on the apparatus main body on the one side end part side in the feed roller pair axis direction; an inner door for supporting one of the rollers of the feed roller pair, supported rotatably with respect to the outer door on the one side end part side in the one roller axis direction. The one roller of the feed roller pair is separated with respect to the other roller at the time of opening the outer door, and thereafter the inner door is rotated while maintaining the angle with respect to the outer door according to the rotation of the outer door.

8 Claims, 12 Drawing Sheets

SHEET FEED DEVICE AND IMAGE FORMING APPARATUS

This application is a divisional of U.S. patent application Ser. No. 10/791,837, filed Mar. 4, 2004, now U.S. Pat. No. 6,993,268.

BACKGROUND OF THE INVENTION

1. Field of the Invention

The present invention relates to a sheet feed device for clamping and feeding a sheet, such as a sheet feed device used for an image forming apparatus such as a copying machine and a laser beam printer.

2. Description of the related Art

Conventionally, the image forming apparatus such as a copying machine and a laser beam printer include the configuration having a door to be opened or closed with respect to the apparatus main body at the time of for example the paper jamming process. In order to facilitate the paper jamming process, there is a configuration of opening the sheet feeding path (sheet clamping) by separating a feed roller pair for clamping and feeding the sheet according to the door opening and closing operation, that is, by separating the rollers comprising the roller pair.

As to the configuration of the door to be opened or closed, for example, one to be opened or closed around the lower side of the door comprising the apparatus side surface exterior as the rotation center, one to be slid and moved in the right and left direction as it is (substantially parallel to the apparatus installation surface), or the like can be presented. For preventing damage of the feed roller pair to be moved away at the time of releasing clamping of the sheet as mentioned above, a configuration of opening or closing by moving parallel the other roller with respect to one roller in the roller axis direction is preferable.

For example, as shown in FIG. 12, there is one having one roller 5 out of a feed roller pair 5, 10 provided between an apparatus main body front side plate 8 and an apparatus main body rear side plate 9 disposed on the side of a door 91 to be opened or closed with respect to the apparatus main body. The one roller 5 provided on the door 91 side is forced to the other roller 10 side on the apparatus main body side by pressure springs 4*a*, 4*b* for obtaining the feeding force. Therefore, in a state with the door 91 opened, the roller 5 on the door 91 side is disposed at a position with a stopper part 3*a* (3*b*) of a roller bearing 3 for supporting the one roller 5 and a stopper part 51*a* (51*b*) of a door 51 are engaged according to the urging force of the pressure springs 4*a*, 4*b*. According to the configuration, since the one roller 5 is pulled out substantially parallel to the other roller 10 according to the opening and closing operation (slide movement) of the door 91 at the time of the paper jamming process, the paper jamming process can be executed by releasing the clamping state of the feed roller pair 5, 10 without damaging the rollers 5, 10.

However, in the case the rotation shaft of the door to be opened or closed with respect to the apparatus main body is provided on the lower side of the door, or in the case the door is slid and moved in the right and left direction in the above-mentioned conventional examples, unless the grip for opening or closing the door is disposed in the substantial center of the door, the opening and closing operation cannot be executed smoothly, and thus a problem of the poor operability is involved.

Furthermore, in the case the rotation axis of the door is provided in the lower side of the door, at the time of opening or closing the door, the user should open the door while supporting the same with the hands, and a problem of the poor operability is involved.

Moreover, in the case the door is slid and moved in the right and left direction as it is, the door can hardly be slid and moved smoothly unless the front and rear sides of the door are well balanced (in the direction substantially orthogonal to the moving direction), and thus a problem of the poor operability is involved. Furthermore, for sliding and moving the door easily and smoothly, a problem of the complication of the mechanism for sliding and moving the door is involved.

Therefore, in order to improve the user operability, as shown in FIG. 11, a configuration of providing the door 51 provided with the rotation axis 51*a* on the apparatus deeper side for opening and closing the door 51 from the apparatus front side to the apparatus deeper side, can be considered. However, in the case of the configuration of opening and closing by separating the feed roller pair 5, 10 as in the above-mentioned conventional example, using the door 51 shown in FIG. 11, the following problem is involved.

As shown in FIG. 11, the one roller 5 provided on the door 51 side out of the feed roller pair 5, 10 provided between the apparatus main body front side plate 8 and the apparatus main body rear side plate 9 is forced to the other roller 10 side on the apparatus main body side by the pressure springs 4*a*, 4*b* for obtaining the feeding force. Therefore, in a state with the door 51 opened, the roller 5 on the door 51 side is disposed at a position with the stopper part 3*a* (3*b*) of the roller bearing 3 for supporting the one roller 5 and the stopper part 51*a* (51*b*) of the door 51 engaged by the urging force of the pressure springs 4*a*, 4*b*. Therefore, by closing the door 51 in this state, since the deeper side end part 5*a* of the roller 5 on the door 51 side is contacted with the circumferential surface of the roller 10 on the apparatus main body side during the closing operation, there is the risk of damaging the circumferential surface of the roller 10 on the apparatus main body side or the deeper side end part 5*a* of the roller 5 on the door 51 side.

For example, in the case the other roller 10 of the feed roller pair is an intermediate transfer belt for bearing a toner image (the reference numeral 152 in FIG. 11 and FIG. 12), a photosensitive drum, or the like, a problem of causing the image deterioration is involved. Or in the case the deeper side end part of the one roller 5 of the feed roller pair is a gear for transmitting the driving force, there is the risk of causing breakage of the members.

SUMMARY OF THE INVENTION

Accordingly, an object of the present invention is to provide a sheet feed device and an image forming apparatus with a good user operability even in the case of separating and releasing a feed roller pair by opening a door from the front side to the deeper side with the rotation axis provided on the deeper side, capable of preventing damage of the members such as the feed roller pair according to the door opening and closing operation.

Still another object of the present invention will become apparent while reading the following detailed explanation with reference to the accompanied drawings.

DETAILED DESCRIPTION OF THE PREFERRED EMBODIMENTS

Hereinafter, with reference to the drawings, preferable embodiments of the present invention will be explained in detail. However, the size of the constituent parts, the material, the shape, the relative arrangement thereof, or the like described in the following embodiments can be optionally changed according to the configuration of the apparatus to adopt the present invention and the various conditions so that the scope of the present invention is not limited thereby unless there is specific description.

Figure 2:
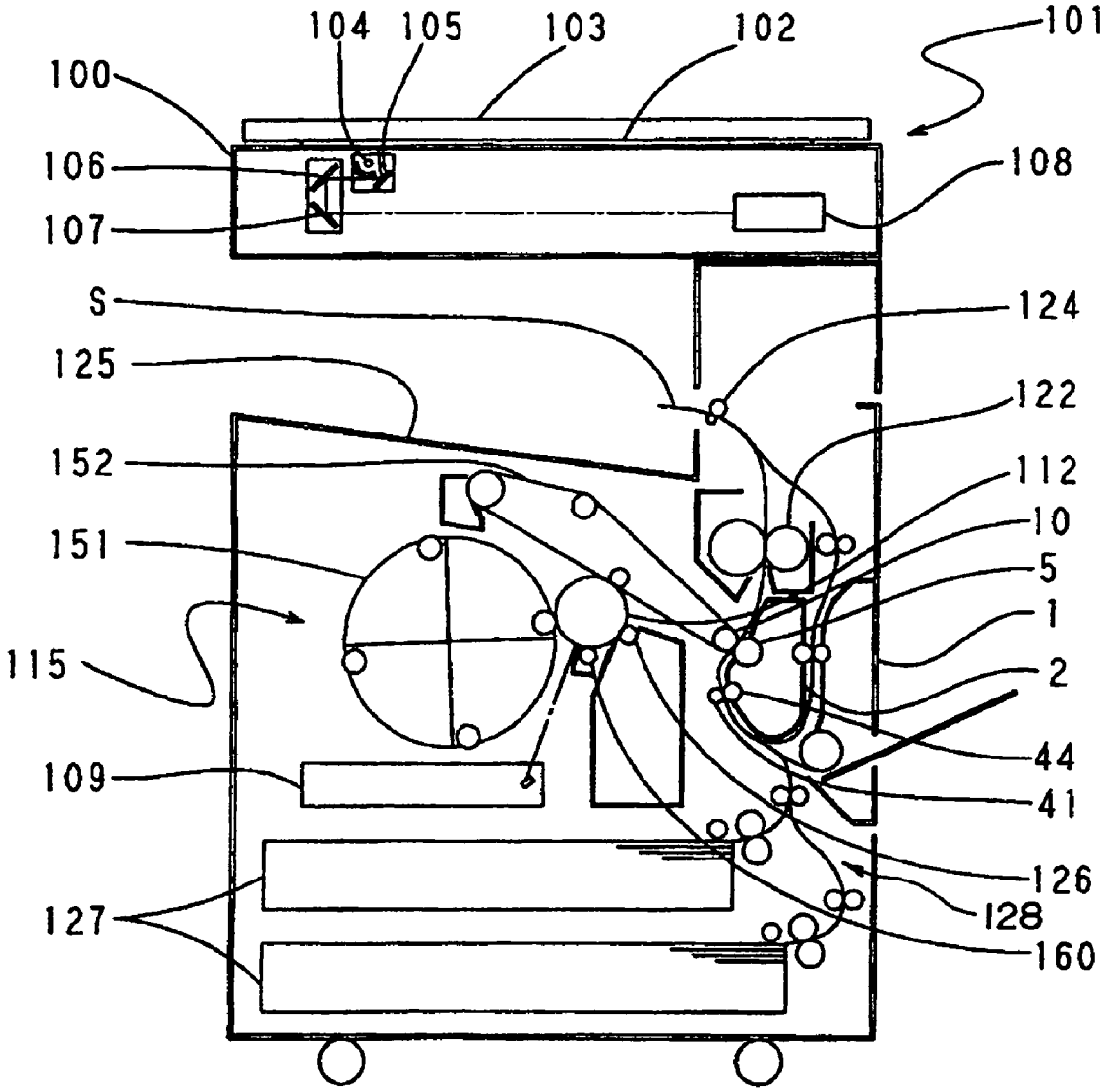
FIG. 2 is a side cross-sectional view schematically showing the schematic configuration of an image forming apparatus comprising a sheet feed device according to an embodiment of the present invention.

First, with reference to FIG. 2, an image forming apparatus using the sheet feed device according to this embodiment of the present invention will be explained. FIG. 2 is a cross-sectional view of the image forming apparatus. An example of a copying machine is shown herein.

In FIG. 2, the reference numeral 101 denotes an image forming apparatus main body, and an original base plate 102 comprising a transparent glass plate is fixedly provided in the upper part of the image forming apparatus main body 101. The reference numeral 103 denotes an original pressing plate, for pressing and fixing an original 100 placed at a predetermined position of the original base plate 102 with the image surface disposed downward. An optical system comprising a lamp 104 for illuminating the original 100, and reflecting mirrors 105, 106, 107 for guiding the light image of the illuminated original 100 to an image processing unit 108 is provided below the original base plate 102. The lamp 104 and the reflecting mirrors 105, 106, 107 are moved by a predetermined rate while scanning the original 100.

An image forming part 115 comprises a photosensitive drum 112, a charge roller 106 for evenly charging the surface of the photosensitive drum 112, a laser unit 109 for forming a latent image on the photosensitive drum 112 by irradiating an image light, a rotary developing unit 151 for forming a toner image on the photosensitive drum 112, an intermediate transfer belt 152 in which the toner image developed on the surface of the photosensitive drum 112 is transferred, a transfer inner roller 10 for collectively transferring the toner image on the intermediate transfer belt 152 to a sheet S, a cleaner 126 for removing the toner remaining on the photosensitive drum 112 after transferring the toner image, or the like. The photosensitive drum 112 develops an electrostatic latent image formed by a light image irradiated from the laser unit 109 on the surface of the photosensitive drum 112 charged by the charge roller 160 and successively transfer and superimpose the same onto the intermediate transfer belt 152. The toner image on the intermediate transfer belt 152 is transferred onto the sheet S collectively by the transfer inner roller 10 of the secondary transfer part. The sheet S is supplied selectively one by one from a sheet cassette 127 by a feeding part 128.

A fixing device 122 for fixing a toner image on the sheet S being fed as a permanent image, and a discharge roller pair 124 for discharging the sheet S with the toner image fixed by the fixing device 122 from the image forming apparatus main body 101 are provided successively on the downstream side of the image forming part 115. A discharge part 125 for receiving the sheet S discharged by the discharge roller pair 124 is provided outside the image forming apparatus main body 101.

Furthermore, the image forming apparatus according to this embodiment comprises a secondary transfer part having a transfer outer roller 5 and a transfer inner roller 10 as the feed roller pair for clamping and feeding the sheet, and a sheet feed device having doors 1, 2 having the rotation axis on the apparatus main body deeper side, for supporting the one transfer outer roller 5 of the secondary transfer part.

As shown in FIGS. 1, 3, 4 and 5, the doors 1, 2 provide the two door configuration of the outer door 1 having a hinge shaft 1*a* to be the rotation axis of the entire door on the apparatus main body 101 deeper side, and the inner door 2 having the hinge shaft 2*c* on the outer door 1 deeper side to rotate with respect to the outer door 1. Then, in the case of opening or closing the doors 1, 2, first by gradually opening the inner door 2 about the outer door hinge shaft 1*a* with respect to the outer door 1, the one roller 5 of the feed roller pair 5, 10 provided to the inner door 2 is moved substantially parallel in the vicinity of the separation part in the axis direction with respect to the other roller 10. Then, after moving the one roller 5 substantially parallel in the vicinity of the separation part in the axis direction with respect to the other roller 10, that is, after opening the outer door 1 with respect to the inner door 2 by a certain angle, the inner door 2 is rotated while maintaining the angle (the above-mentioned certain angle) with respect to the outer door 1 according to the further rotation of the outer door 1. It is possible that the one roller 5 is separated by slightly moving obliquely with respect to the other roller 10 for separating the roller pair without damaging the roller pair by the rotation as in the conventional example.

Figure 1:
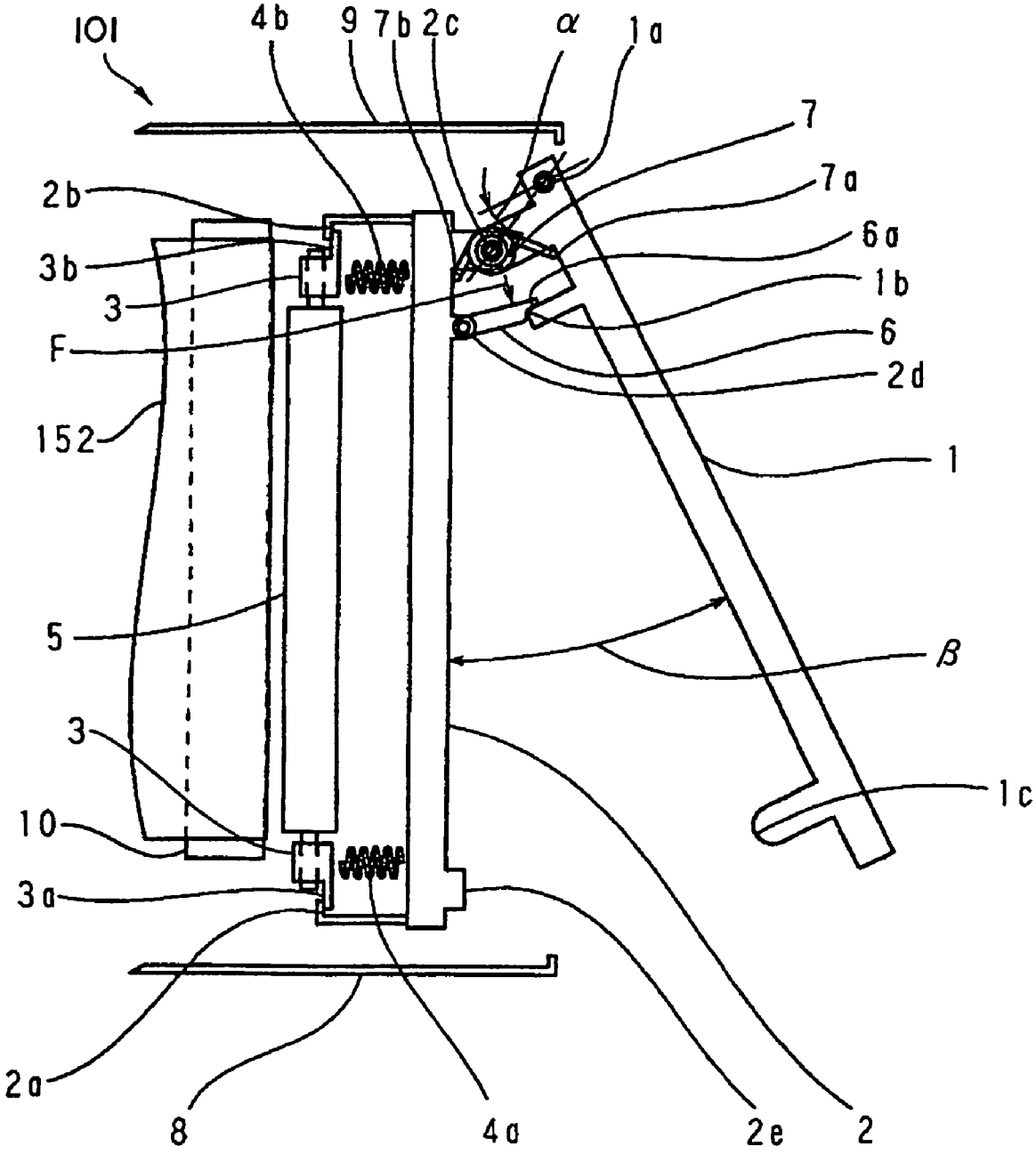
FIG. 1 is a plan view of a door and a feed system in the vicinity of the door according to an embodiment of the present invention.
Figure 3:
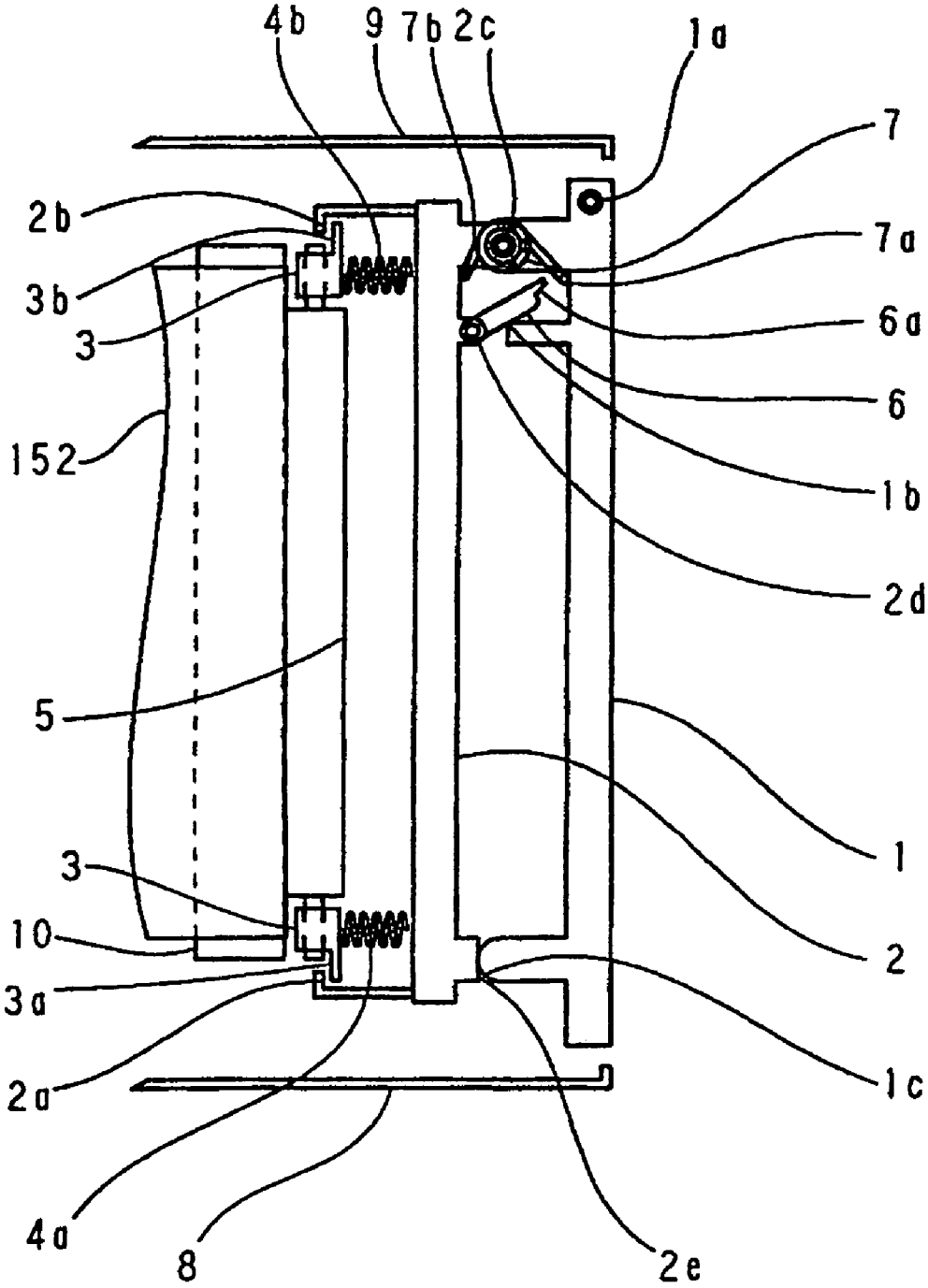
FIG. 3 is a plan view of a door and a feed system in the vicinity of the door according to an embodiment of the present invention.
Figure 4:
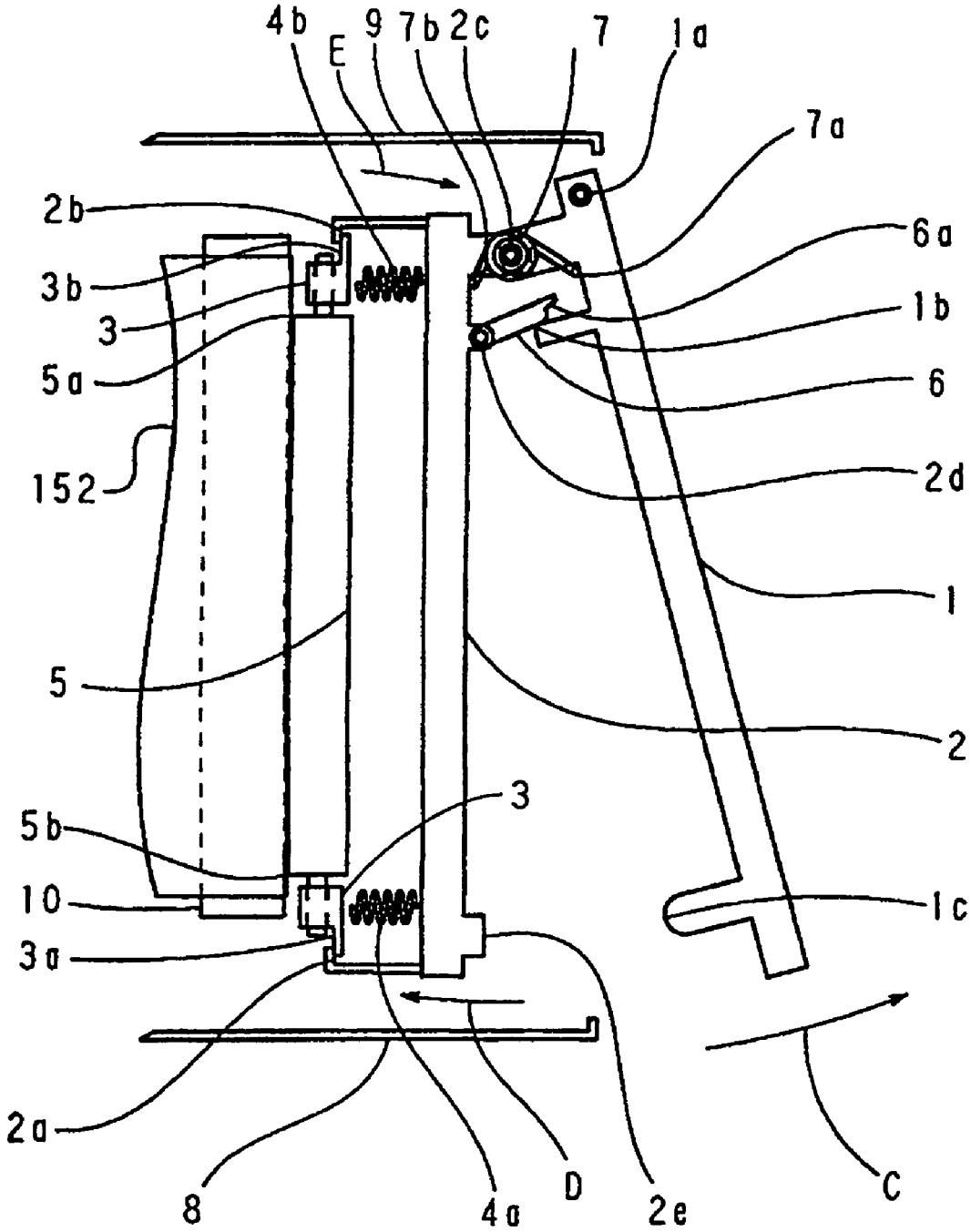
FIG. 4 is a plan view of a door and a feed system in the vicinity of the door according to an embodiment of the present invention.
Figure 5:
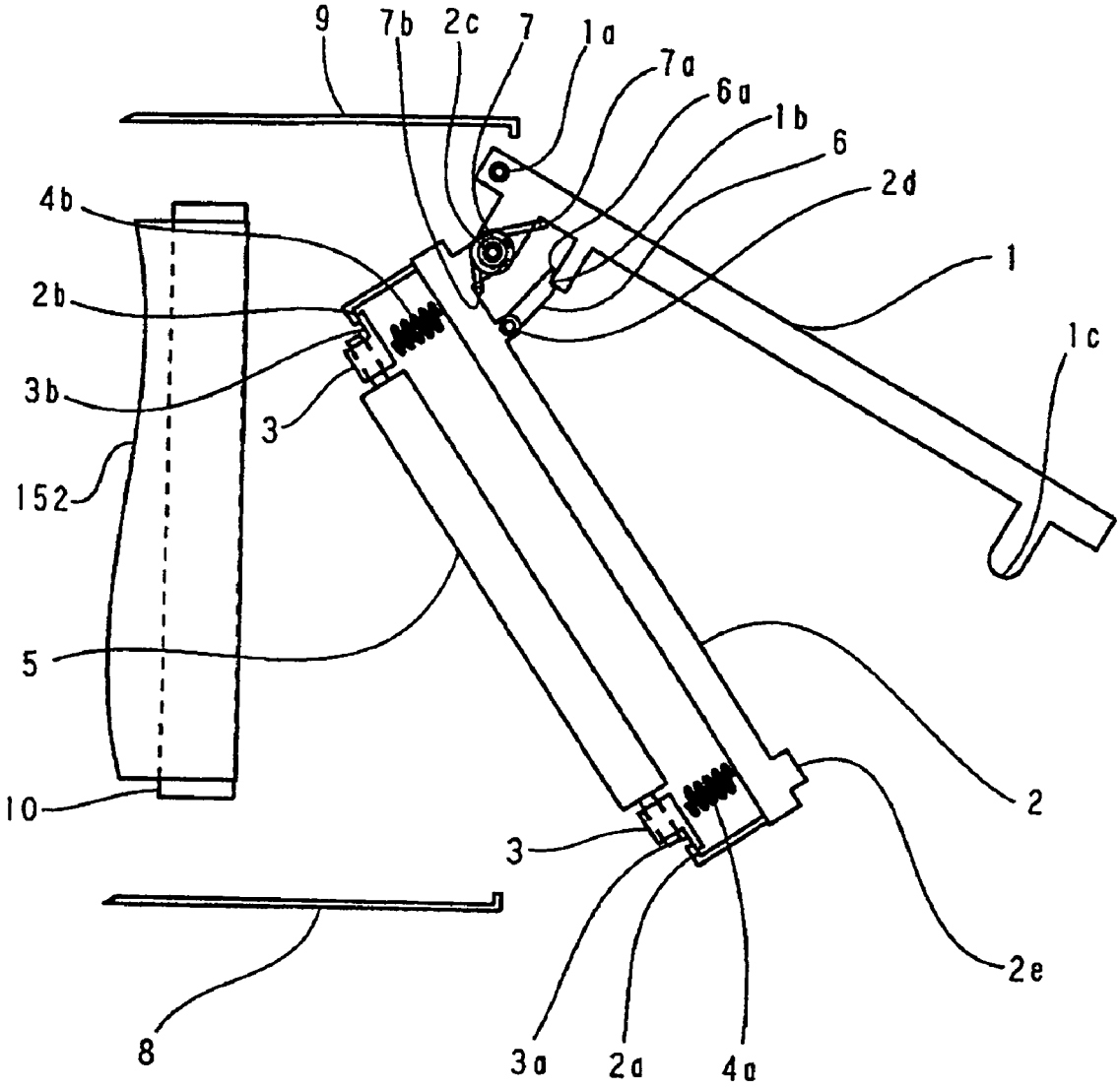
FIG. 5 is a plan view of a door and a feed system in the vicinity of the door according to an embodiment of the present invention.

Hereinafter, with reference to FIGS. 1, 3, 4 and 5, the characteristic parts will be explained in detail. FIGS. 1, 3, 4 and 5 are schematic drawings of the door and the feed system in the vicinity of the door of the sheet feed device in the image forming apparatus according to this embodiment, viewed from above. FIG. 3 is a drawing with the door in a closed state, and FIGS. 4, 1, 5 are drawings in the halfway of the door opening and closing operation.

The ordinary state is the door closed state shown in FIG. 3. The transfer inner roller 10 constituting the secondary transfer part as the feed roller pair is disposed between the apparatus main body front side plate 8 and the apparatus main body rear side plate 9 so that the transfer inner roller 10 is rotated following the intermediate transfer belt 152 to be driven by an unshown driving means.

The outer door 1 is to be rotated with respect to the apparatus main body rear side plate 9 by the outer door hinge shaft 1*a* as the rotation axis of the entire door, and the apparatus main body front side as the free end is engaged with the apparatus main body front side plate 8 by an unshown lock mechanism. The inner door 2 is rotated with respect to the outer door 1 by the inner door hinge shaft 2, and it positions the door and stop the rotation thereof by receiving the positioning part 1*c* provided on the free end side of the outer door 1 at the positioning part 2*e* provided on the free end side. Moreover, the inner door 2 has the transfer outer roller 5 constituting the secondary transfer part as the feed roller pair such that the transfer outer roller is forced by the pressure springs 4*a*, 4*b* so as to press the transfer inner roller 10. According to the pressure, the sheet S is clamped and fed by the transfer roller pair 5, 10 via the intermediate transfer belt 152. Moreover, the gap between the outer door 1 and the inner door 2 constituting the door forms a feeding path for guiding the sheet (see FIG. 1).

Next, the movement of the above-mentioned constituent elements at the time of opening the door will be explained. As shown in the state in FIG. 3 to FIG. 4, in the case the outer door 1 is opened to the arrow C direction, the inner door 2 is to be opened in the arrow D direction by an inner door opening spring 7 with the end parts 7*a*, 7*b* engaged with the doors 1, 2 respectively. However, since the transfer outer roller 5 on the inner door 2 side is pressured against the transfer inner roller 10 on the apparatus main body side by the pressure springs 4*a*, 4*b*, the inner door 2 has the apparatus deeper side opened in the arrow E direction with the front side end part 5*b* of the transfer outer roller 5 as the substantial fulcrum. As a result, the transfer outer roller 5 on the inner door 2 side is opened substantially parallel in the axis direction with respect to the transfer inner roller 10 on the apparatus main body side.

Then, as shown in FIG. 1, in a state with the transfer outer roller 5 on the door side separated from the transfer inner roller 10 on the apparatus main body side, the roller 5 on the inner door 2 side is disposed at a position with the stopper parts 3*a*, 3*b* of the roller bearing 3 for supporting the one transfer outer roller 5 and the stopper parts 2*a*, 2*b* of the inner door 2 engaged according to the urging force of the pressure springs 4*a*, 4*b*. As it is understood from the state shown in FIG. 1, according to the configuration of this embodiment, the transfer outer roller 5 on the door side is opened substantially parallel in the axis direction with respect to the transfer inner roller 10 on the apparatus main body side.

Moreover, as shown in FIG. 1, a lock mechanism for locking the inner door 2 with respect to the outer door 1 in a state with the opening angle β of the outer door 1 and the inner door 2 satisfy the relationship with respect to the angle α formed by the straight line linking the outer door hinge shaft 1*a* center and the inner door hinge shaft 2*c* center and the straight line from the outer door hinge shaft 1*a* center perpendicular to the outer door 1 of $\beta \geqq \alpha$ (certain angle or more), is provided. That is, in the case the opening angle β of the outer door 1 and the inner door. 2 satisfies the above-mentioned relationship, the opening stopper member 6 mounted rotatably on the stopper axis 2*d* of the inner door 2 is rotated in the arrow F direction by the urging force of an unshown pressuring member so that the engaging part 6*a* of the stopper member 6 is engaged with the engaging projection 1*b* on the outer door 1 side, and the inner door 2 is in the locked state with respect to the rotating outer door 1. From the locked state shown in FIG. 1, the inner door 2 is opened following the outer door 1 as shown in FIG. 5 in a state locked with the outer door 1. Thereby, according to this embodiment, the roller pair 5, 10 to have the clamped state opened according to the door opening operation is rotated about the door axis as shown in FIG. 5 after separated substantially parallel in the axis direction as shown in FIG. 1.

At the time of closing the door, it is operated in the opposite order (FIG. 5→FIG. 1→FIG. 4→FIG. 3) with respect to the above-mentioned order (FIG. 3→FIG. 4→FIG. 1→FIG. 5). That is, according to this embodiment, in the order opposite to the door opening operation, since the roller pair 5, 10 to be contacted in the clamped state according to the door closing operation is in a state separated substantially parallel in the axis direction as shown in FIG. 1 before releasing the engagement of the stopper member 6 on the inner door 2 side and the engaging projection 1*b* on the outer door 1 side, even in the case the door is rotated from this state to the state shown in FIG. 4 (engagement released state), the roller pair 5, 10 is contacted with the substantially parallel state in the axis direction maintained.

As mentioned above, according to this embodiment, even in the case of separating and opening the feed roller pair by opening the door from the front side to the deeper side with the rotation axis provided on the deeper side, by gradually opening the inner door with respect to the outer door 1 about the outer door hinge shaft 1*a*, since one of the roller 5 of the feed roller pair 5, 10 is moved substantially parallel with respect to the other roller 10 in the axis direction, the user operability is good. Furthermore, since the feed roller pair 5, 10 is opened or closed substantially parallel in the axis direction, damage of the feed roller pair accompanied by the door opening or closing operation can be prevented.

Although the configuration of supporting or releasing the support of the opening angle β of the outer door 1 and the inner door 2 is provided in the lock mechanism shown in FIGS. 1 and 2 by engaging or releasing the engagement of the rotatable stopper member 6 pressured in the arrow F direction on the inner door 2 side and the engaging projection 1*b* on the outer door 1 side, the lock mechanism of the doors 1, 2 according to the present invention is not limited thereto, and it may be provided as follows.

Figure 6:
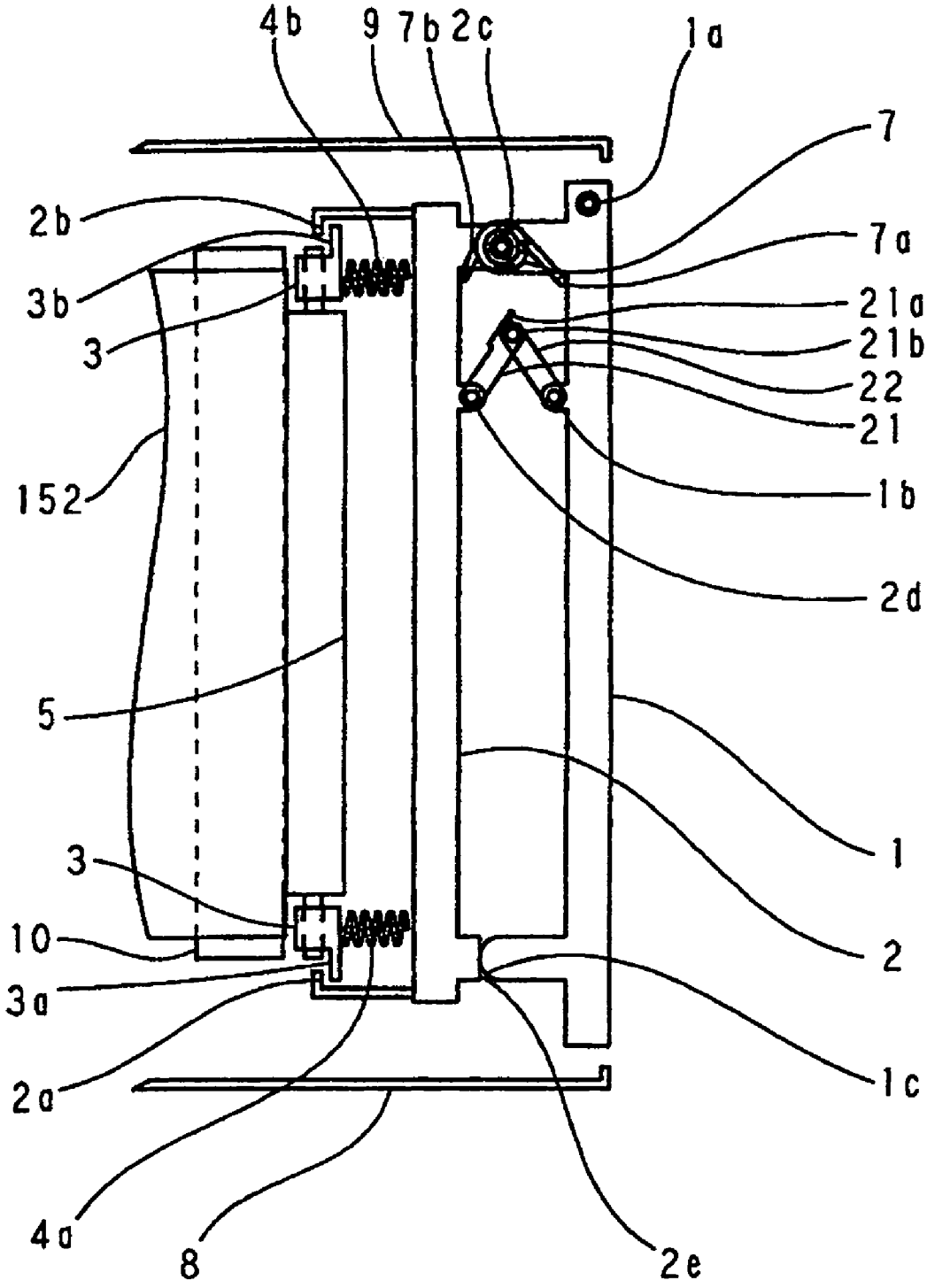
FIG. 6 is a plan view of a door and a feed system in the vicinity of the door according to an embodiment of the present invention.
Figure 7:
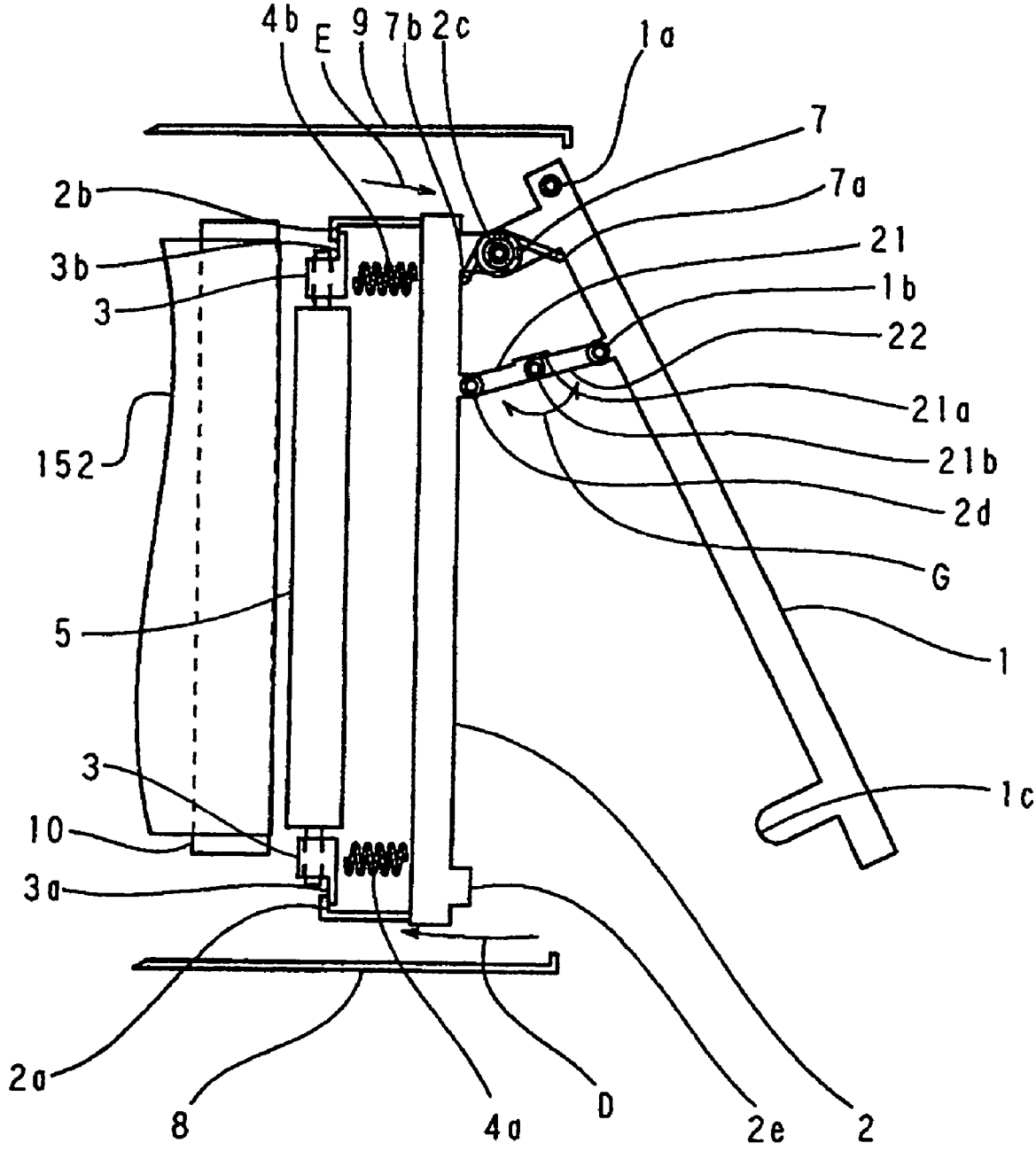
FIG. 7 is a plan view of a door and a feed system in the vicinity of the door according to an embodiment of the present invention.

As shown in FIGS. 6, 7, the lock mechanism comprises a first link 21 provided rotatably on a shaft 2*d* of the inner door 2, and a second link 22 provided rotatably on a shaft 21*b* of the first link 21 and a shaft 1*d* of the outer door 1. At the time of opening the outer door 1 with respect to the inner door 2 from the state shown in FIG. 6, the links 21, 22 are opened in the arrow G direction shown in FIG. 7 with the shaft 21*b* as the fulcrum by a pressure member such as an unshown torsion coil spring, or the like so that the inner door 2 is in a state locked with the rotating outer door 1 according to the engagement of the stopper part 21*a* of the first link 21 and the second link 22.

Since the other schematic configuration of the apparatus is same as that shown in FIGS. 1 and 2, the same reference numerals are applied on the members having the same function, and detailed explanation is omitted here.

According to the lock mechanism, at the time of separating and opening the feed roller pair by opening the doors from the front side to the deeper side with the rotation shaft provided on the deeper side, the user operability is good. Furthermore, since the feed roller pair 5, 10 is opened or closed substantially parallel in the axis direction, damage of the feed roller pair accompanied by the door opening or closing operation can be prevented.

Although an example of the transfer roller pair 5, 10 constituting the secondary transfer part is explained as the feed roller pair for clamping or releasing the clamp according to the opening or closing operation of the doors 1, 2 in the configuration shown in FIGS. 1 and 2, the present invention is not limited thereto, and it can be provided as follows.

Figure 8:
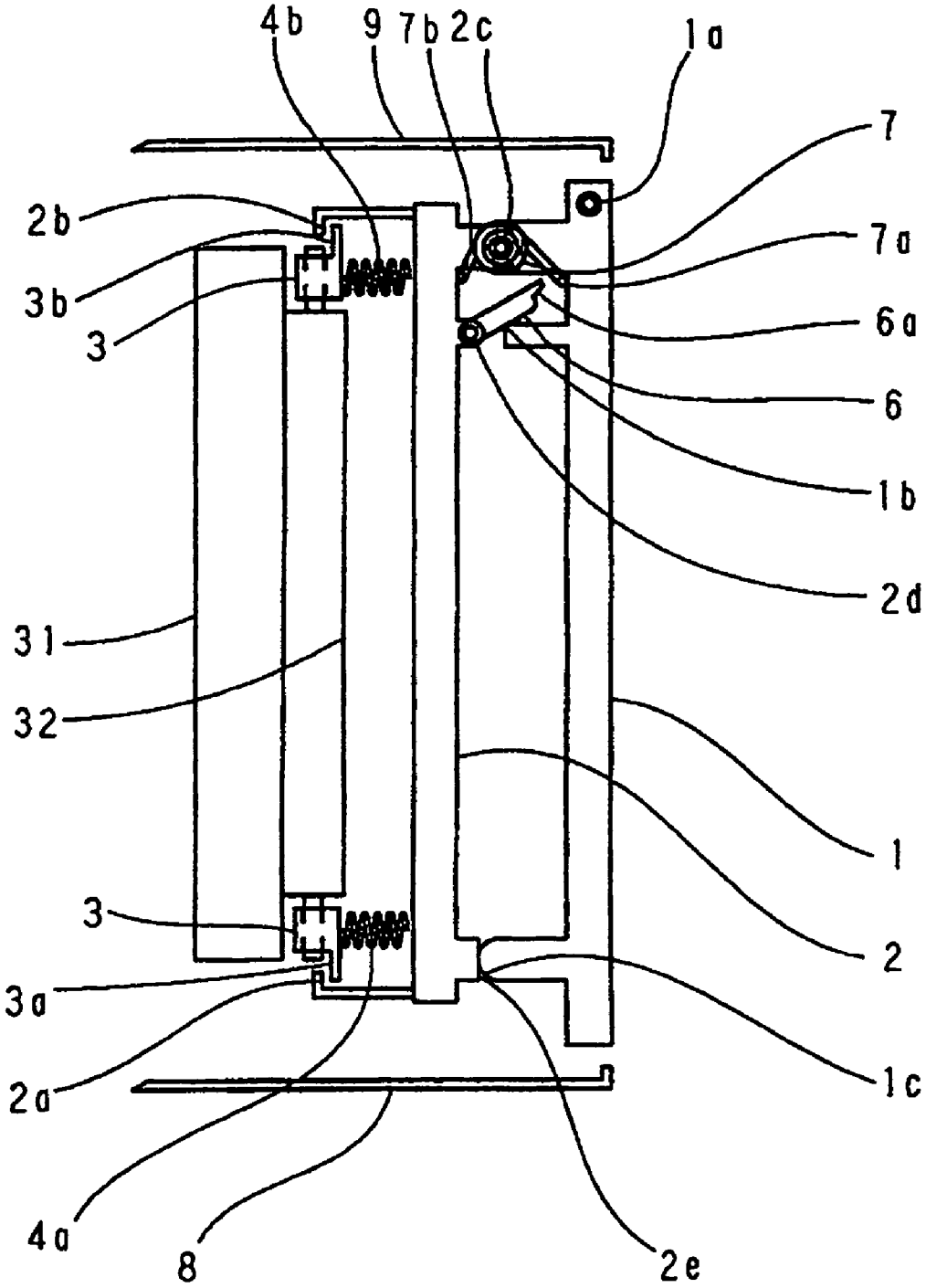
FIG. 8 is a plan view of a door and a feed system in the vicinity of the door according to an embodiment of the present invention.

In an image forming apparatus for transferring a toner image formed on the photosensitive drum 31 as the image bearing member in an image forming part onto a sheet fed from a feeding part by the transfer roller 32, as shown in FIG. 8, an example of the feed roller pair for clamping or releasing the clamp accompanied by the opening or closing operation of the doors 1, 2 is shown as a roller pair 31, 32 comprising the photosensitive drum 31 and the transfer roller 32. In this case, as shown in FIG. 8, the transfer roller 32 provided on the door side is opened or closed substantially parallel in the axis direction with respect to the photosensitive drum 31 on the apparatus main body side accompanied by the opening or closing operation of the doors 1, 2.

Either in the case of this configuration, or in the case of separating and opening the feed roller pair by opening the doors from the front side to the deeper side with the rotation axis provided on the deeper side, the user operability is good. Furthermore, since the feed roller pair 31, 32 is opened substantially parallel in the axis direction, damage of the feed roller pair accompanied by the door opening or closing operation can be prevented.

Furthermore, the next configuration can also be adopted. As the feed roller pair for clamping or releasing the clamp according to the opening or closing operation of the doors 1, 2, a roller pair comprising each of the rollers of the feed roller pair to be driven by a gear can be used.

Figure 9:
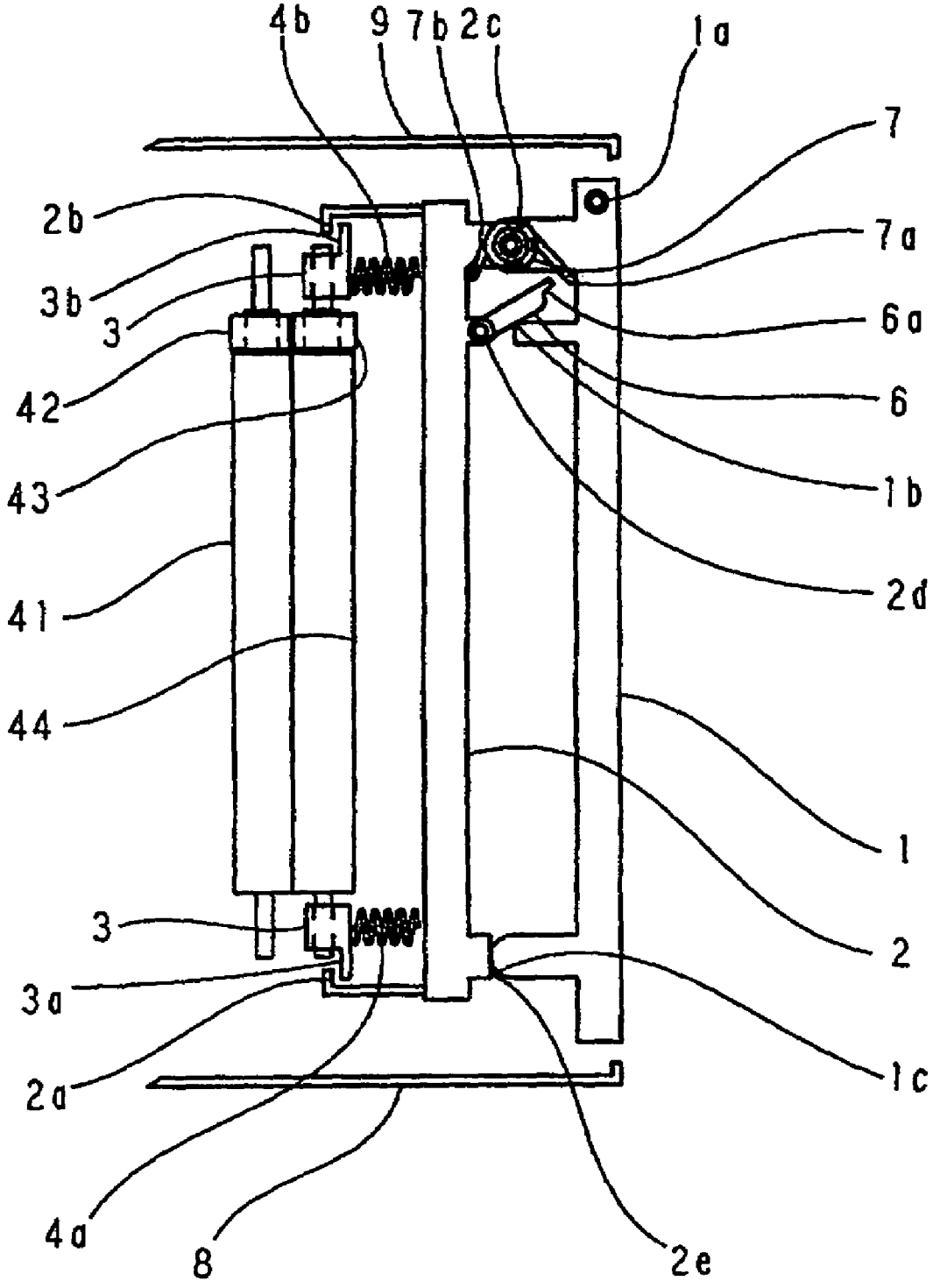
FIG. 9 is a plan view of a door and a feed system in the vicinity of the door according to an embodiment of the present invention.

Here, a registration roller pair 41, 44 is shown as an example. As shown in FIG. 9, the registration roller pair 41, 44 comprises a registration roller 41 disposed on the apparatus main body side and a registration roller 44 disposed on the door side. The main body side registration roller 41 is rotated and driven by an unshown driving source. Thereby, the drive is transmitted from the main body side registration roller gear 42 engaged with the deeper side end part of the main body side registration roller 41 to the door side registration roller gear 43 engaged with the deeper side end part of the door side registration roller 44 so that the door side registration roller 44 is rotated and driven.

Since the other schematic configuration of the apparatus is same as that shown in FIGS. 1 and 2, the same reference numerals are applied on the members having the same function and detailed explanation is omitted here.

According to the registration roller pair of the configuration, by disposing the registration roller 44 of the registration roller pair on the inner door 2 of the doors 1, 2 shown in FIGS. 1 and 2, the user operability is good. Furthermore, since the feed roller pair 41, 44 is opened or closed substantially parallel in the axis direction, damage of the feed roller pair accompanied by the door opening or closing operation can be prevented.

Although an example of one pair of the feed roller pair for clamping or releasing the clamp according to the opening or closing operation of the doors comprising the outer door and the inner door in a sheet feed device or an image forming apparatus is explained in this embodiment, the present invention is not limited thereto, and a plurality of the feed roller pairs for clamping or releasing the clamp according to the opening or closing operation of the doors comprising the outer door and the inner door in a sheet feed device or an image forming apparatus can be provided.

For example, both the transfer roller pair 5, 10 as the feed roller pair and the registration roller pair 41, 44 as the feed roller pair may be opened or closed substantially parallel in the axis direction according to the opening or closing operation of the doors comprising the outer door 1 and the inner door 2. According to this configuration, not only the same effect as in the above-mentioned embodiment can be obtained but also the user operability can further be improved since the feeding path can be opened in a wider range.

Figure 10:
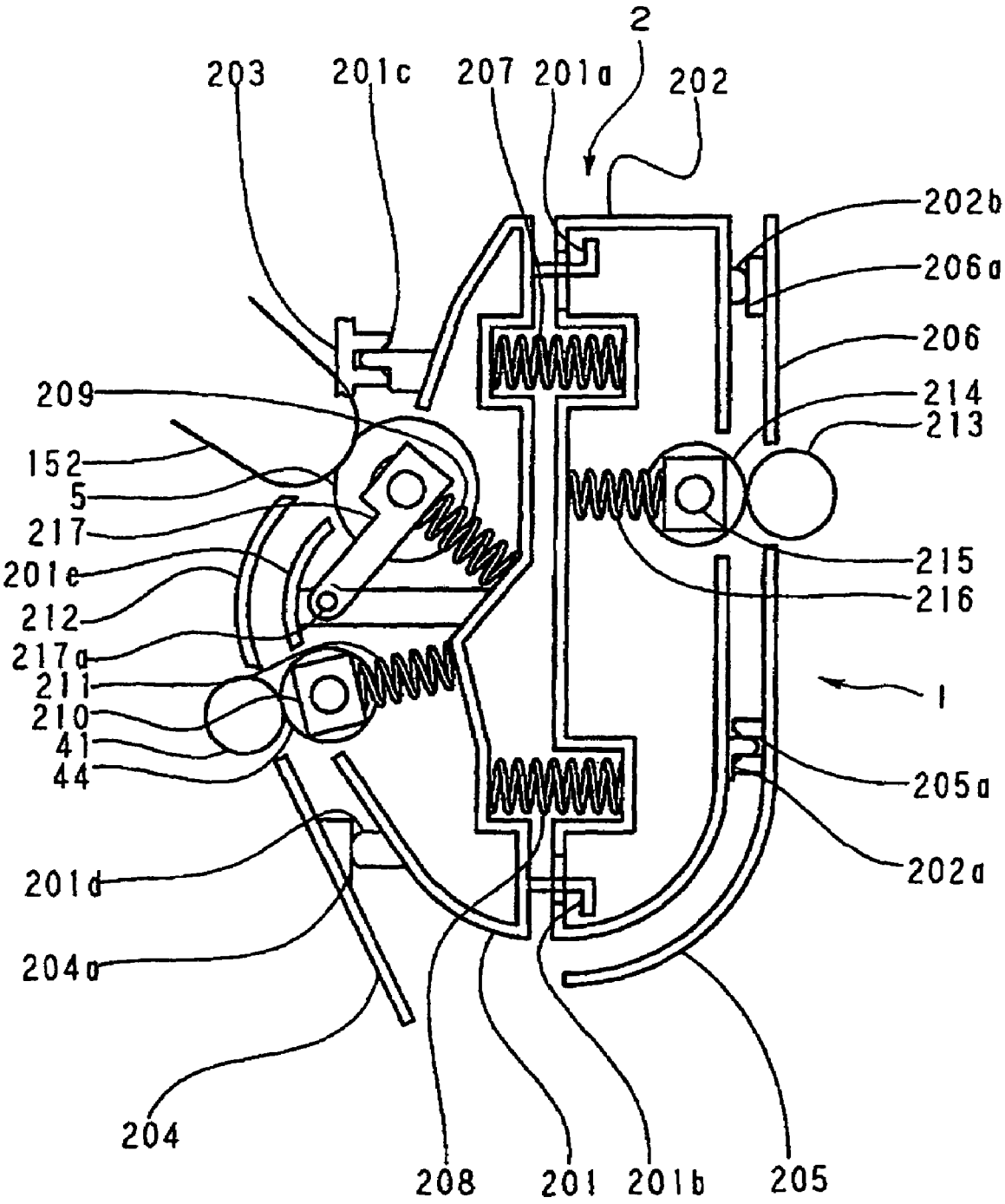
FIG. 10 is a plan view of a door and a feed system in the vicinity of the door according to an embodiment of the present invention.
Figure 11:
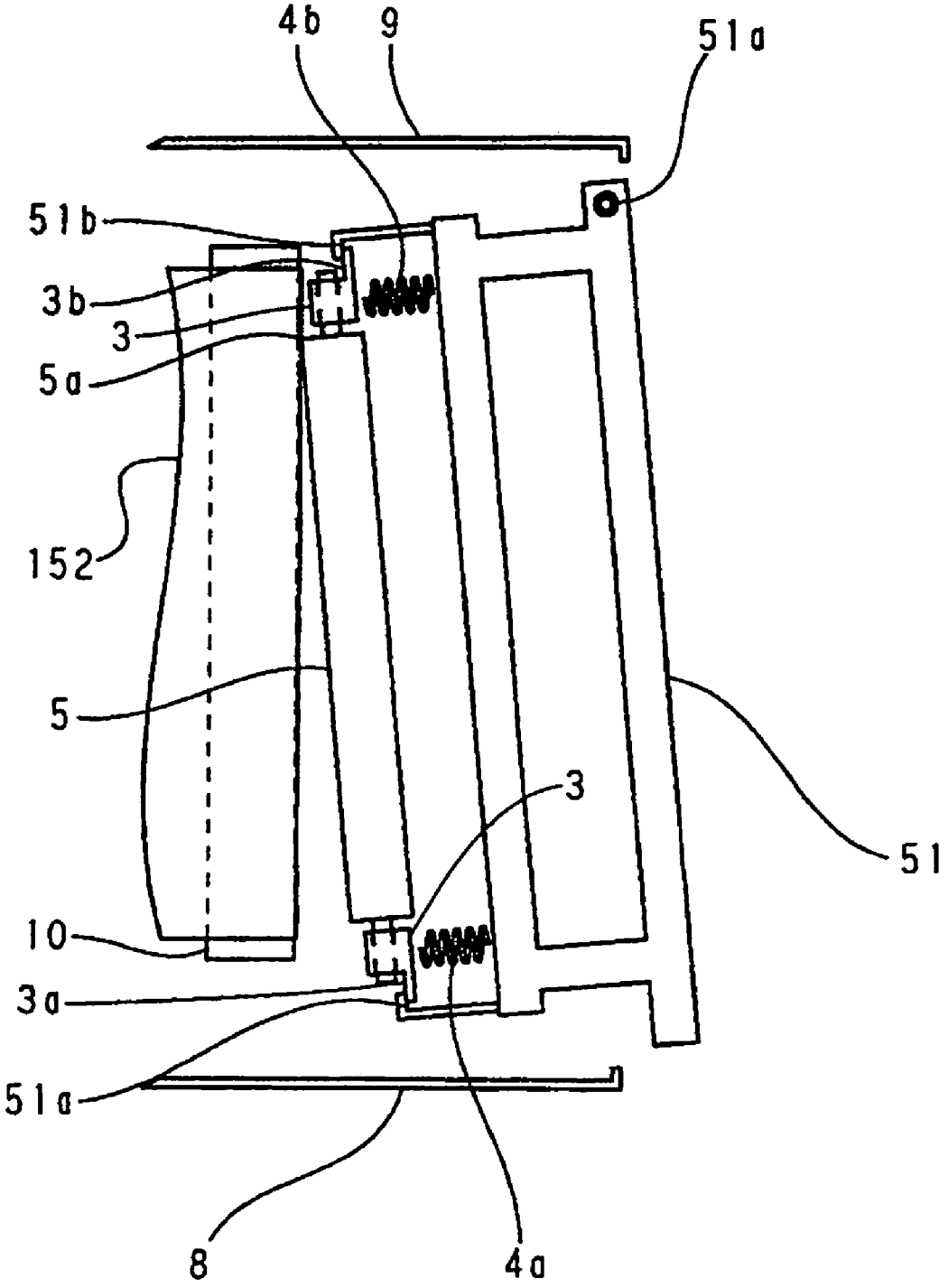
FIG. 11 is a plan view of a door and a feed system in the vicinity of the door according to the conventional sheet feed device.
Figure 12:
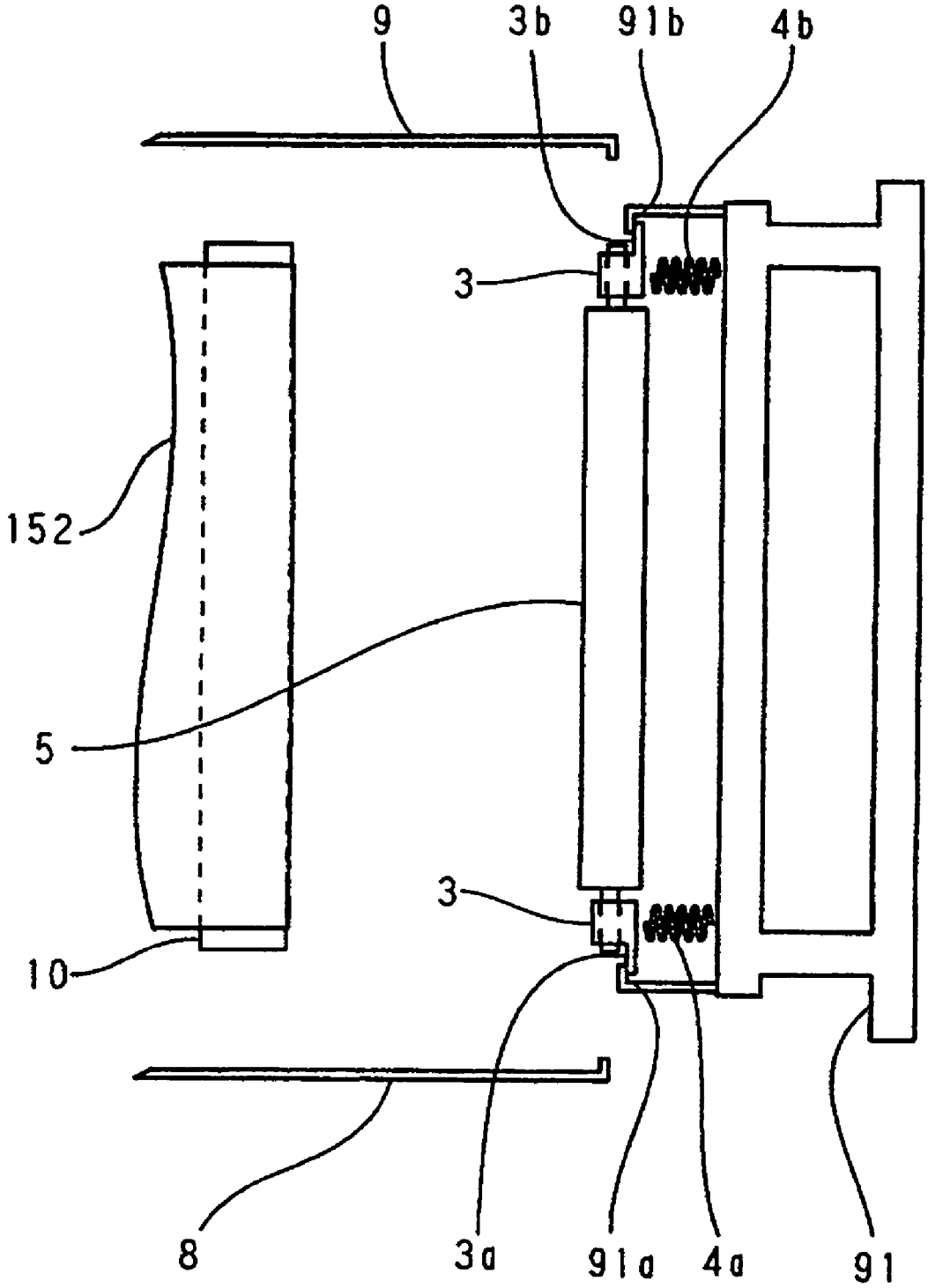
FIG. 12 is a plan view of a door and a feed system in the vicinity of the door according to the conventional sheet feed device.

FIG. 10 is a schematic diagram showing an example of the present invention adopted in a sheet feed device in an image forming apparatus, viewed from the front side.

Out of the doors comprising the outer door 1 and the inner door 2, the inner door 2 comprises a first feed part 201 for feeding a sheet with respect to the apparatus main body, and a second feed part 202 for feeding the sheet with respect to an outer door 1. The first feed part 201 and the second feed part 202 constituting the inner door 2 have the float configuration with springs 207, 208 provided therebetween. In the figure, the reference numerals 201*a*, 201*b* denote limiting members for limiting separation of the feed parts 201, 202 by more than a predetermined amount by the springs 207, 208.

In the first feed part 201 disposed on the apparatus main body side of the inner door 2, one of the transfer outer roller 5 constituting the secondary transfer part as the feed roller pair is forced by a spring 209 so as to be supported rotatably by a supporting member 217 swayable about the fulcrum 217*a*. Furthermore, one of the registration roller 44 of the registration roller pair as the feed roller pair is forced by a spring 211 so as to be supported rotatably by a bearing 210 movable parallel by an unshown slide mechanism. Moreover, the first feed part 201 is positioned by positioning parts 201*c*, 201*d* provided on the first feed part 201 side and positioning parts 203, 204*a* provided on the apparatus main body side.

Moreover, in the figure, the reference numeral 201*e* denotes a feed guide provided in the inner door 2 for forming a feeding path for guiding a sheet on the first feed part side of the inner door 2. The reference numerals 204, 212 denote feed guides provided on the apparatus main body side for forming the feeding path for guiding a sheet together with the feed guide on the first feed part side of the inner door 2.

In contrast, in the second feed part 202 disposed on the outer door side of the inner door 2, one of a feed roller 214 of a feed roller pair 213, 214 for feeding a sheet in the feeding path with respect to the outer door 1 is forced by a spring 216 so as to be supported rotatably by a bearing 215 movable parallel by an unshown slide mechanism. Moreover, the second feed part 202 is positioned by positioning parts 202*a*, 202*b* provided on the second feed part 202 side and outer door positioning parts 205*a*, 206*a* provided on the outer door 1 side.

Moreover, in the figure, the reference numerals 205, 206 denote feed guides provided in the outer door 1 for forming a feeding path for guiding a sheet together with the feed guide formed by the second feed part 202 of the inner door 2.

Since the other schematic configuration of the apparatus is same as that shown in FIGS. 1 and 2, the same reference numerals are applied on the members having the same functions and detailed explanation is omitted here.

Accordingly, in the apparatus for separating and opening the feed roller pair by opening the door from the front side to the deeper side with the rotation axis provided on the deeper side, since a plurality of the feeding paths disposed between the door and the apparatus main body can be opened or closed, and the feed parts (a plurality of the feed roller pairs) for clamping and feeding the sheet in the feeding paths can be opened or closed substantially parallel in the axis direction, not only the damage of the feed roller pair accompanied by the door opening or closing operation can be prevented but also the user operability can further be improved.

Since the second feed part disposed between the outer door 1 and the inner door 2 is the feed roller pair 213, 214 and the offset amount of the roller with respect to the normal direction of the roller and the hinge shaft in the roller axis direction is small, the roller can hardly be flawed, and even in the case it is flawed, since the roller pair is the feed roller pair as mentioned above, the feed failure cannot be generated by the feeding force deterioration derived from several flaws.

Although the number of the developing units provided in the rotary developing unit as the rotation type developing unit has not been described specifically in the above-mentioned embodiment, the number of use is not limited, and it can be set optionally as needed.

Moreover, although an example of a copying machine as the image forming apparatus is shown in the embodiment, the present invention is not limited thereto. For example, other image forming apparatus such as a printer, and a facsimile machine, image forming apparatus using a transfer drum instead of a transfer belt as the intermediate transfer member for transferring and superimposing toner images of each color successively on the transfer drum, and transferring the transferred toner images collectively onto a transfer medium, or image forming apparatus using a transfer material bearing member such as a transfer feed belt, and a transfer drum for transferring and superimposing toner images of each color successively on the transfer member bore on the transfer material bearing member may be used as well. By adopting the present invention to the sheet feed device used for the image forming apparatus, the same effect can be obtained.

Moreover, although an example of a sheet feed device for feeding a sheet such as a recording paper as the recording subject has been described in the embodiment, the present invention is not limited thereto. For example, by adopting the present invention to the sheet feed unit for feeding a sheet such as an original as the reading subject, the same effect can be obtained.

Moreover, although an example of the electrophotographic system as the recording system has been described in the embodiment, it is not limited thereto. For example, another recording system such as the ink jet system can be used as well.

What is claimed is:

1. An image forming apparatus comprising;

a feeding path which guides a sheet:

a transfer member and an image bearing member which are in pressure contact with each other and transfer the toner image onto the sheet passed through the feeding path;

an openable and closable member which opens and closes the feeding path, wherein the transfer member is mounted on the openable and closable member and the image bearing member is mounted on an apparatus main body, and the transfer member and the image bearing member are in pressure contact with each other when the openable and closable member is closed, and:

a supporting member which supports the openable and closable member, the supporting member mounted rotatably by a rotation axis provided on a back side of the apparatus main body, wherein, when the supporting member is rotated, the openable and closable member is first moved so that the transfer member is separated from the image bearing member by substantial parallel movement and thereafter the transfer member is rotated with the supporting member.

2. The image forming apparatus according to claim 1, wherein the transfer member is urged against the image bearing member by a plurality of pressure springs and the openable and closable member is biased to be opened from the supporting member by an opening spring, wherein the substantial parallel movement of the transfer member is a result of the plurality of pressure springs and a force of the opening spring.

3. The image forming apparatus according to claim 1, wherein said openable and closable member is supported by a rotation axis provided on the supporting member.

4. The image forming apparatus according to claim 1, wherein until rotation of the supporting member reaches a prescribed angle, the openable and closable member is moved substantially without rotating, and thereafter the first openable and closable member is rotated.

5. The image forming apparatus according to claim 4, further comprise a lock mechanism which locks the openable and closable member with respect to the supporting member at the prescribed angle.

6. The image forming apparatus according to claim 5, wherein said lock mechanism comprises a first link provided rotatably on the openable and closable member, a second link provided rotatably on the supporting member and a shaft that rotatably connects said first link and second link.

7. The image forming apparatus according to claim 1, wherein the transfer member is a transfer outer roller and the image bearing member is a secondary transfer member on which toner images are successively transferred and superimposed and the transfer roller transfers the toner images of the secondary transfer member collectively onto the sheet.

8. The image forming apparatus according to claim 1, wherein the transfer member is a transfer roller and the image bearing member is a transfer drum and the transfer roller transfers the toner images of the transfer drum onto the sheet.

* * * * *

UNITED STATES PATENT AND TRADEMARK OFFICE

CERTIFICATE OF CORRECTION

PATENT NO. : 7,317,887 B2
APPLICATION NO. : 11/293143
DATED : January 8, 2008
INVENTOR(S) : Otaka It is certified that error appears in the above-identified patent and that said Letters Patent is hereby corrected as shown below:

COLUMN 1:
Line 17, “include” should read --includes--.

COLUMN 4:
Line 17, “transfer and superimpose” should read --transfer and superimposes--.

COLUMN 5:
Line 17, “stop” should read --stops--.

COLUMN 6:
Line 35, “roller 5” should read --rollers 5--.
Line 65, “is same” should read --is the same--.

COLUMN 7:
Line 56, “is same” should read --is the same--.

COLUMN 8:
Line 40, “roller 44” should read --rollers 44--.

COLUMN 9:
Line 5, “is same” should read --is the same--.

Signed and Sealed this

Twenty-ninth Day of July, 2008

JON W. DUDAS
*Director of the United States Patent and Trademark Office*